US007753300B2

(12) United States Patent
Abramson et al.

(10) Patent No.: US 7,753,300 B2
(45) Date of Patent: Jul. 13, 2010

(54) SHREDDER ADAPTED TO ENCOURAGE THE SETTLING OF SHREDDED MATERIAL THEREIN AND A METHOD OF SHREDDING

(76) Inventors: Aron Abramson, 2025 E. 9 St., Brooklyn, NY (US) 11223; Charles Sued, 3360 Bedford Ave., Brooklyn, NY (US) 11210

( * ) Notice: Subject to any disclaimer, the term of this patent is extended or adjusted under 35 U.S.C. 154(b) by 70 days.

(21) Appl. No.: 11/846,506

(22) Filed: Aug. 28, 2007

(65) Prior Publication Data

US 2009/0057455 A1 Mar. 5, 2009

(51) Int. Cl.
*B02C 23/00* (2006.01)

(52) U.S. Cl. ..... 241/100; 241/236

(58) Field of Classification Search ..... 241/100, 241/236

See application file for complete search history.

(56) References Cited

U.S. PATENT DOCUMENTS

| | | | | |
|---|---|---|---|---|
| 3,094,290 | A * | 6/1963 | Engi | 241/100 |
| 6,962,301 | B1 * | 11/2005 | Chang | 241/100 |
| 7,387,059 | B2 * | 6/2008 | Kobayashi | 83/684 |
| 2005/0006504 | A1 * | 1/2005 | Butler | 241/65 |

* cited by examiner

*Primary Examiner*—Faye Francis
(74) *Attorney, Agent, or Firm*—Garcia-Zamor IP Law; Ruy M. Garcia-Zamor

(57) ABSTRACT

A shredder adapted to encourage the settling of shredded material therein and method of shredding material.

15 Claims, 6 Drawing Sheets

FIG. 3
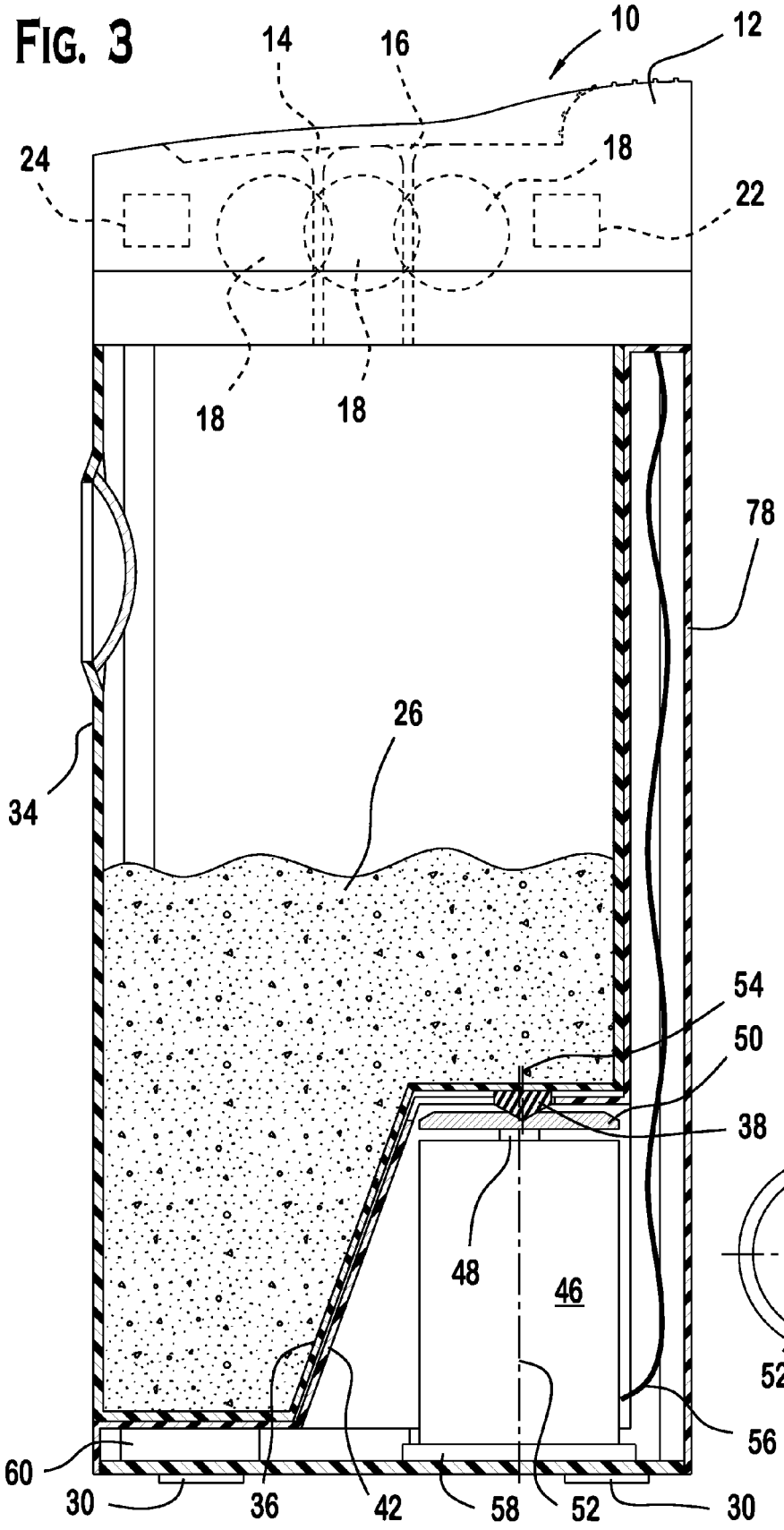
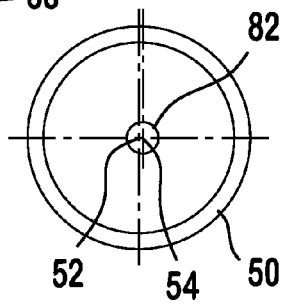
FIG. 3A

SHREDDER ADAPTED TO ENCOURAGE THE SETTLING OF SHREDDED MATERIAL THEREIN AND A METHOD OF SHREDDING

BACKGROUND

The present invention is generally directed to shredders and, more specifically, to a shredder adapted to settle shredded material therein.

Conventional shredders collect shredded material in a shredder basket that must be emptied on a regular basis. Often, air can be trapped within shredded materials or voids in the volume contained by the shredder basket can occur due to the orientation of the pieces of shredded material. This can result in a shredder basket needing to be changed more often than otherwise necessary.

It would be advantageous to provide a shredder that preferably attempts to reduce the volume occupied by shredded material to increase the amount of shredding that can be performed prior to needing to empty the shredder basket.

SUMMARY

Briefly speaking, one embodiment of the present invention is directed to a shredder adapted to encourage the settling of shredded material therein. The shredder including a shredder head housing defining a slot adapted to receive material to be shredded. A plurality of shredder blades are disposed within the shredder head housing and are adapted to shred material inserted into the slot. A shredder basket is located proximate the shredder head housing and is adapted to receive the material shredded by the plurality of shredder blades. A vibration mechanism is located in the shredder and is adapted to vibrate the shredder basket to facilitate the settling of the material therein.

In a separate aspect, one embodiment of the present invention is directed to a method of shredding material. The method includes: providing a shredder defining at least one slot for receiving material, the shredder comprising a plurality of shredder blades adapted to shred the material inserted into the at least one slot, the shredder including a shredder basket for receiving the material after shredding; and mechanically vibrating the shredder basket to encourage the settlement of the material therein.

In a separate aspect, one embodiment of the present invention is directed to a method of shredding material. The method includes: providing a shredder defining at least one slot for receiving material, the shredder comprising a plurality of shredder blades adapted to shred the material inserted into the at least one slot, the shredder including a shredder basket for receiving the material after shredding; automatically mechanically vibrating the shredder basket to encourage the settlement of the material therein when the plurality of shredder blades are deactivated.

In a separate aspect, the present invention is directed to a method of shredding material. The method includes: providing a shredder defining at least one slot for receiving material, the shredder comprising a plurality of shredder blades adapted to shred the material inserted into the at least one slot, the shredder including a shredder basket for receiving the material after shredding; monitoring the shredder basket to initially detect a bin full condition, which is when the material has filled a predetermined amount of the shredder basket; automatically mechanically vibrating the shredder basket when the bin full condition is initially detected; after the automatic mechanical vibration in response to initially detecting the bin full condition, automatically rechecking the shredder basket to determine whether settlement of the material therein has eliminated the bin full condition.

In a separate aspect, one embodiment of the present invention is directed to a shredder adapted to encourage the settling of shredded material therein. The shredder includes a shredder housing comprising a shredder head housing defining a slot adapted to receive material to be shredded. A plurality of shredder blades are disposed within the shredder head housing and are adapted to shred the material inserted into the slot. A shredder basket comprises a housing and an opening located proximate the shredder head housing and adapted to receive the material shredded by the plurality of shredder blades. The housing of the shredder basket defines a fold spaced from the opening. The shredder housing extends generally downwardly from the shredder head housing and defines a chamber adapted to slidably receive the shredder basket. A vibration mechanism is located in the chamber and adapted to vibrate the shredder basket to facilitate the settling of the material therein when the shredder basket is fully inserted into the chamber. The fold of the shredder basket is configured such that at least a portion of the vibration mechanism is located therein when the shredder basket is fully inserted in the chamber.

BRIEF DESCRIPTION OF THE DRAWINGS

The foregoing summary, as well as the following detailed description of the preferred embodiments of the present invention will be better understood when read in conjunction with the appended drawings. For the purpose of illustrating the invention, there are shown in the drawings embodiments which are presently preferred. It is understood, however, that the invention is not limited to the precise arrangements and instrumentalities shown. In the drawings:

FIG. 3 is a vertical cross-sectional view of the shredder of FIG. 1 illustrating preferred possible configurations for the vibration mechanism; the vibration mechanism may include a guide wheel having a major surface oriented generally perpendicularly to the shredder basket rod. The guide wheel preferably has a guide slot therein to provide arcuate force to the rod of the shredder basket, in this instance the central axis of the vibration mechanism's motor's shaft is preferably offset from the central axis of the rod; alternatively, the vibration mechanism can exert linear force on the rod in a reciprocating manner;

FIG. 3A is a top plan view of the guide wheel of the shredder of FIG. 3 illustrating the guide slot and the central axis of the vibration mechanism shaft and the central axis of the rod of the shredder basket;

DETAILED DESCRIPTION OF THE PREFERRED EMBODIMENTS

Figure 1:
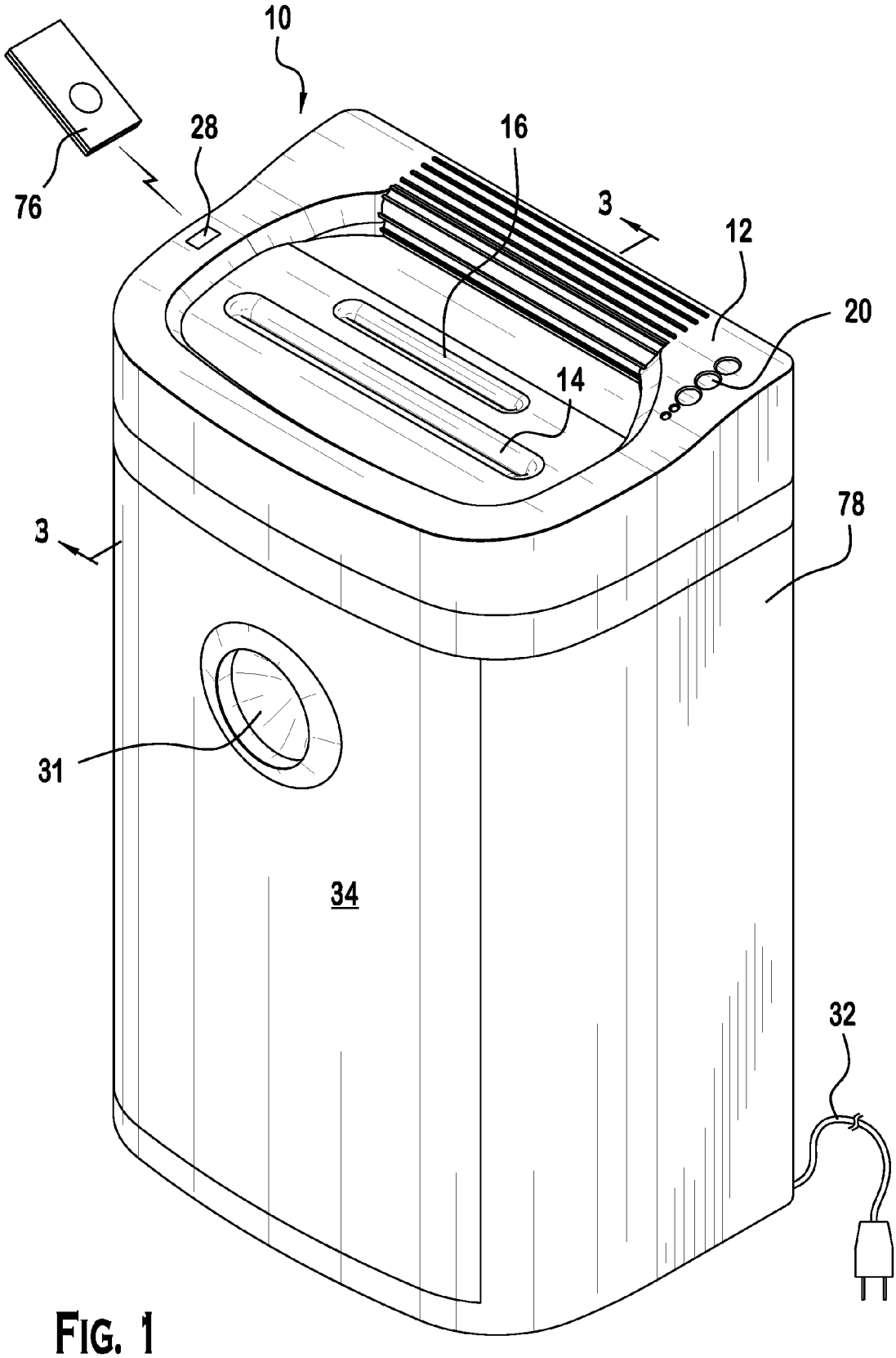
FIG. 1 is a perspective view of a shredder according to a preferred embodiment of the present invention; the shredder preferably includes a selectable control for manually activating a vibration mechanism adapted to settle shredded material located in the shredder basket; A remote control is also shown that may be used to activate the vibration mechanism remotely.

Certain terminology is used in the following description for convenience only and is not limiting. The words "right," "left," "top," and "bottom" designate directions in the drawings to which reference is made. The words "inwardly" and "outwardly" refer to directions toward and away from, respectively, the geometric center of the shredder and designated parts thereof. The term "activated" as used with shredder blades means that the blades are moved in whatever manner results in shredding (i.e., that the blades 18 are operating for shredding). Similarly, the term "deactivated" when used with shredder blades means that the shredder blades are operating for shredding purposes. The term "selectable control", as used in the claims and the corresponding portions of the specification, means "any one of a physical switch, a touch switch, a button, a voice activated switch, a control knob, a remote control switch, or any other known operating mode selection device". The term "activated state", as used with selectable control, means that the selectable control has been manipulated so that the selectable control is set for a particular function. For example, if the selectable control is a simple switch, then the activated state may be having the switch turned to another position and if the selectable control is a touch sensor, then the activated state may be initiated by depressing or touching the sensor in a predetermined manner. The language "at least one of 'A', 'B', and 'C'," as used in the claims and in corresponding portions of the specification, means "any group having at least one 'A'; or any group having at least one 'B'; or any group having at least one 'C';—and does require that a group have at least one of each of 'A', 'B', and 'C'." Additionally, the words "a" and "one" are defined as including one or more of the referenced item unless specifically stated otherwise. The terminology includes the words above specifically mentioned, derivatives thereof, and words of similar import.

Referring to FIGS. 1-6, wherein like numerals indicate like elements throughout, there is shown a preferred embodiment of a shredder 10 adapted to facilitate the settling of shredded material 26 therein. Briefly speaking, the shredder 10 uses a vibration mechanism 40 to generate vibrations that encourage the shredded material 26 to settle in a shredder basket 34.

Referring to FIGS. 1 and 3, one embodiment of the present invention includes a shredder with a shredder head housing 12. The shredder head housing 12 defines at least one slot 14, 16 for inserting material to be shredded. The primary slot 14 guides material to be shredded to shredder blades 18 that are driven by a motor 24 located in the shredder head housing 12. The plurality of shredder blades 18 are disposed within the shredder head housing 12 and are adapted to shred material inserted into one of the slots 14, 16. The first slot 14 is preferably used for paper documents and the second slot 16 is preferably used for more rigid documents, such as credit cards, compact discs, etc.

The shredder preferably receives power from an outlet via a power conduit, such as an electrical cord, 32. However, the shredder can be powered by batteries or any other suitable power source.

Figure 2:
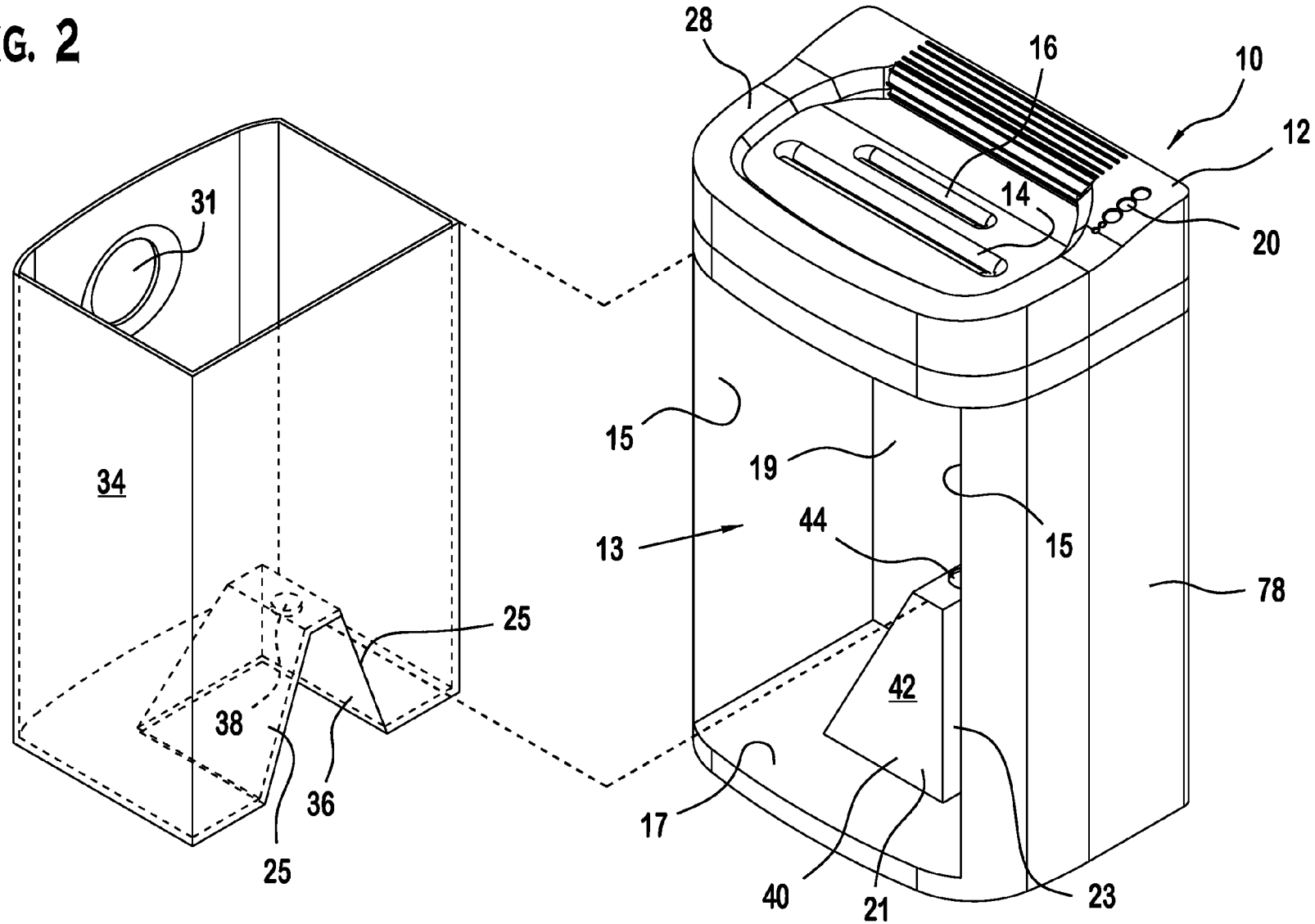
FIG. 2 is another perspective view of the shredder of FIG. 1 illustrating the shredder basket removed from a chamber defined by the shredder housing; A generally trapezoidal fold is preferably located in the shredder basket to allow at least a portion of the vibration mechanism to be inserted therein; a rod may be located in the fold that extends generally downwardly for mating with a bore in the top of the vibration mechanism housing.

Referring to FIGS. 1 and 2, while the preferred shredder head housing 12 has a generally rectilinear shape, those of ordinary skill in the art will appreciate from this disclosure that the shredder head housing 12 can have any shape without departing from the scope of the present invention. The shredder head may also include a bin full indicator 20 or other operational indicators and/or controls. Shredder head handles may be located on the left and right lateral sides of the shredder head housing 12 to allow easy lifting of the shredder head from the shredder basket 34.

The shredder 10 can have a shredder head housing 12 that is placed directly on the shredder basket 34 or similar waste can (when using this configuration the vibration machine 40 may be located in the shredder head housing 12 or removeably attached to the shredder basket 34). Alternatively, a shredder housing 78 may extend generally downwardly from the shredder head housing 12 to define a chamber 13 adapted to slidably receive the shredder basket 34.

The chamber 13 preferably has a bottom side 17, two lateral sides 15 and a rear side 19. The vibration mechanism 40 is preferably located proximate the intersection of the bottom 17 and rear 19 sides and may be positioned generally equidistantly between the two lateral sides 15. It is preferred that the vibration mechanism housing 42 have a semi-pyramidal shape with angled front 21 and lateral 23, 25 sides. The angling of the front and lateral sides 21, 23, 25 of the vibration mechanism make it easier to slidably engage a fold 36 in the shredder basket 34 therewith.

Referring to FIGS. 2 and 3, the shredder basket 34 is preferably located proximate to the shredder head housing 12 and is adapted to receive the material 26 shredded by the plurality of shredder blades 18. As best shown in FIG. 2, the shredder basket 34 preferably has a housing and an opening located proximate the shredder head housing 12 and is adapted to receive the material 26 shredded by the plurality of shredder blades 18. The housing of the shredder basket 34 preferably defines a fold 36 spaced from the opening that is adapted to slidably engage the vibration mechanism 40.

Referring to FIGS. 2 and 3, the shredder basket 34 may include a rod 38 located thereon. The vibration mechanism 40 may include a motor 46 that moves the rod 38 to vibrate the basket. One preferred location for the rod 38 is within an apex at the top of the shredder basket fold 36. The vibration mechanism housing 42 may include a bore 44 therein to allow the rod 38 to be positioned therethrough.

The vibration mechanism 40 is preferably located in the shredder 10 and is adapted to vibrate the shredder basket 34 to facilitate the settling of the material 26 therein. Alternatively, the vibration mechanism 40 may be a separate component that is attached (either permanently affixed or in a removable fashion) to allow the retrofit of existing shredder systems.

When the vibration mechanism 40 shown in FIG. 2 is used, the shredder basket fold 36 is preferably configured such that at least a portion of the vibration mechanism 40 is located in the fold 36 when the shredder basket 34 is fully inserted into the chamber 13. While a particular configuration of the fold 36 is shown any suitable configuration can be used without departing from the scope of the present invention.

Referring to FIGS. 3 and 3A, one preferred embodiment of the shredder may include a guide wheel 50 that is mounted at the end of the motor shaft 48. The motor shaft 48 central axis 52 and the shredder basket rod 38 central axis 54 are preferably offset from each other with the lower end of the rod riding in a guide slot 82 located in the guide wheel 50. The motor 46 preferably drives the rod 38 via rotation of the guide wheel 50. The rod 38 may be engaged with the guide slot 82 so that rotation of the wheel drives the rod 38 in a generally arcuate manner. Alternatively, the motor 46 may drive the rod 38 (or the shredder basket 34 directly) in a linear manner.

Figure 4:
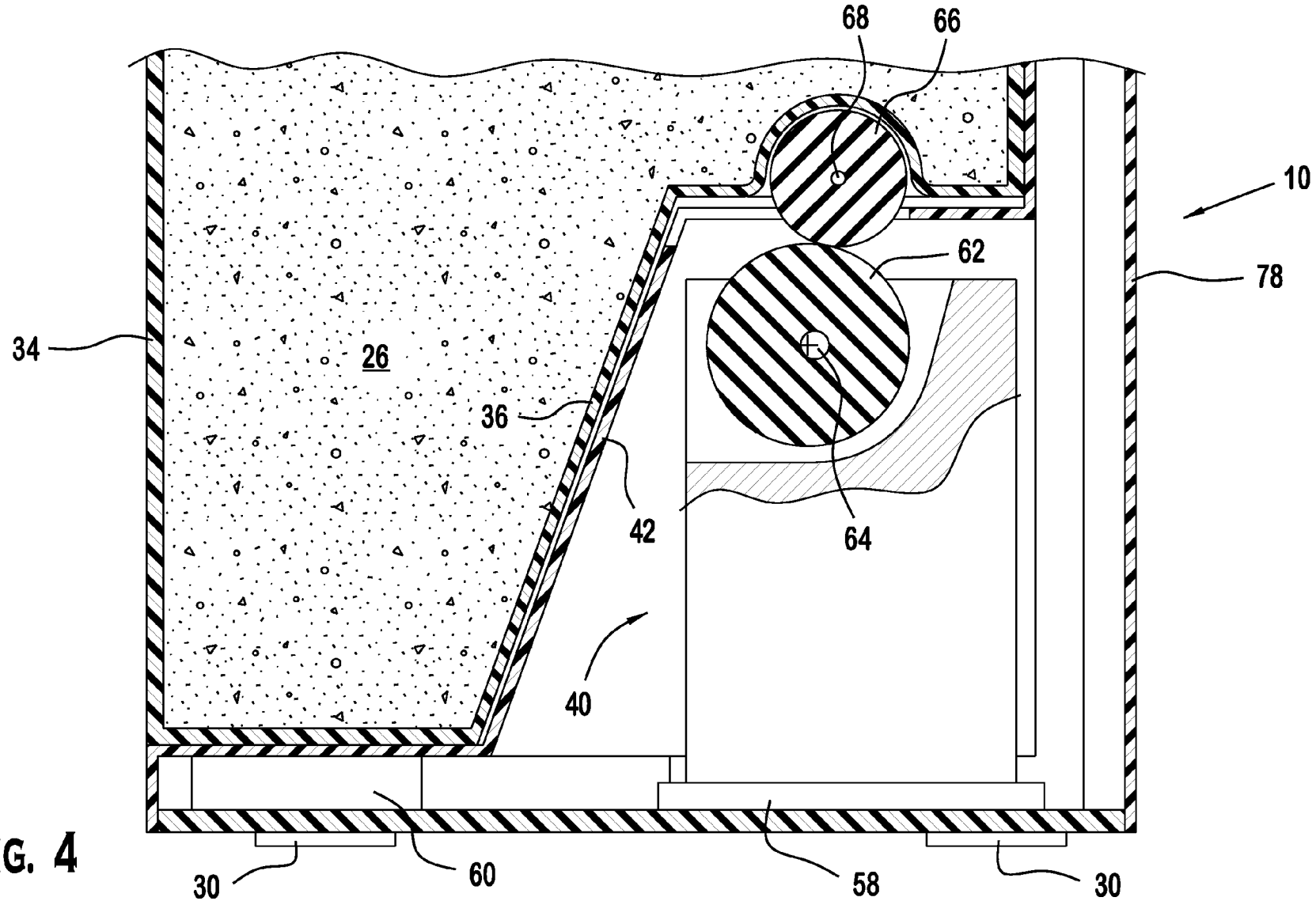
FIG. 4 is a partial cross-sectional view similar to FIG. 3 illustrating an alternative preferred vibration mechanism that utilizes an drive wheel that is eccentrically mounted to provide vibrations to the shredder basket via a driven wheel secured to the shredder basket.

Referring to FIG. 4, an alternate preferred vibration mechanism 40 is shown. The shredder basket 34 may include a driven wheel 66 that is rotatably mounted therein for rotation about a driven wheel axis 68. The vibration mechanism 40 may include an eccentrically mounted drive wheel 62 (rotatably mounted on axis 64) configured to engage the driven wheel 66 to vibrate the shredder basket 34. The driven wheel may extend from the shredder basket 34 and partially through the vibration mechanism housing 42. A support 60 may be used to provide stability to the shredder housing 78 along the base of the shredder 10 proximate the opening of the chamber 13. Feet 30 may be rubberized to reduce vibrations transmitted to the surrounding environment. Alternatively, the vibration mechanism 40 may be configured to linearly move the feet 30 to vibrate the shredder housing 78 and indirectly vibrate the shredder basket 34.

Figure 5:
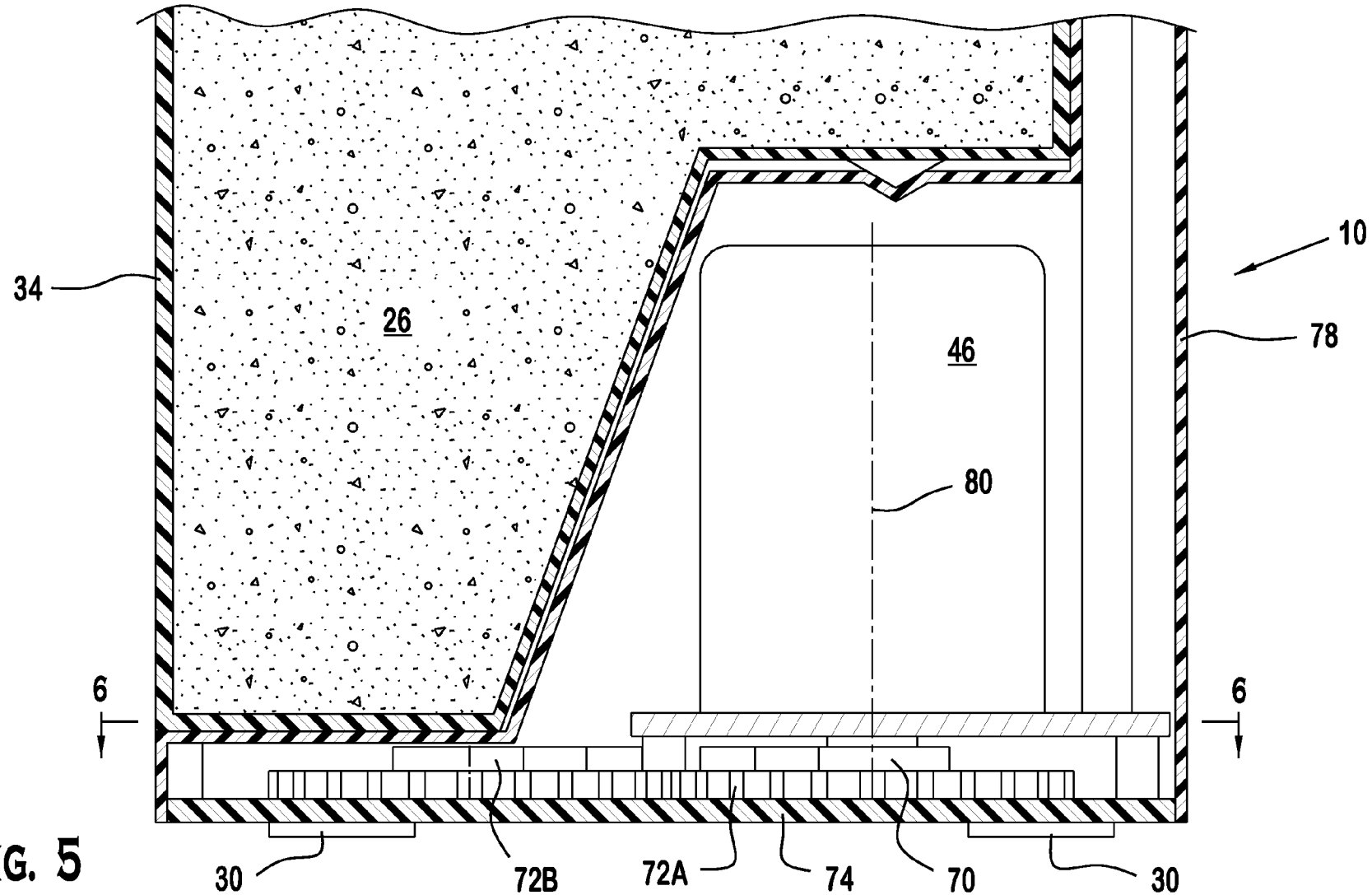
FIG. 5 is a partial cross-sectional view similar to FIG. 3 illustrating another alternative preferred vibration mechanism that uses eccentrically weighted gears (the eccentric weights are shown in dashed lines) to vibrate the shredder housing to transmit vibrations to the shredder basket; the motor is preferably secured to a base plate that is mounted to the bottom of the shredder housing; the motor drives a drive gear that engages first through third driven gears to generate vibrations; Any alternative suitable gearing can be used without departing from the scope of the present invention; Similarly, any other suitable shredder basket vibration method can be used (including vibrating the shredder housing to indirectly vibrate the shredder basket, vibrating the shredder head housing to indirectly vibrate the shredder basket, or vibrating the shredder basket directly (via either an affixed vibration mechanism or a detachable vibration mechanism)) without departing from the scope of the present invention.
Figure 6:
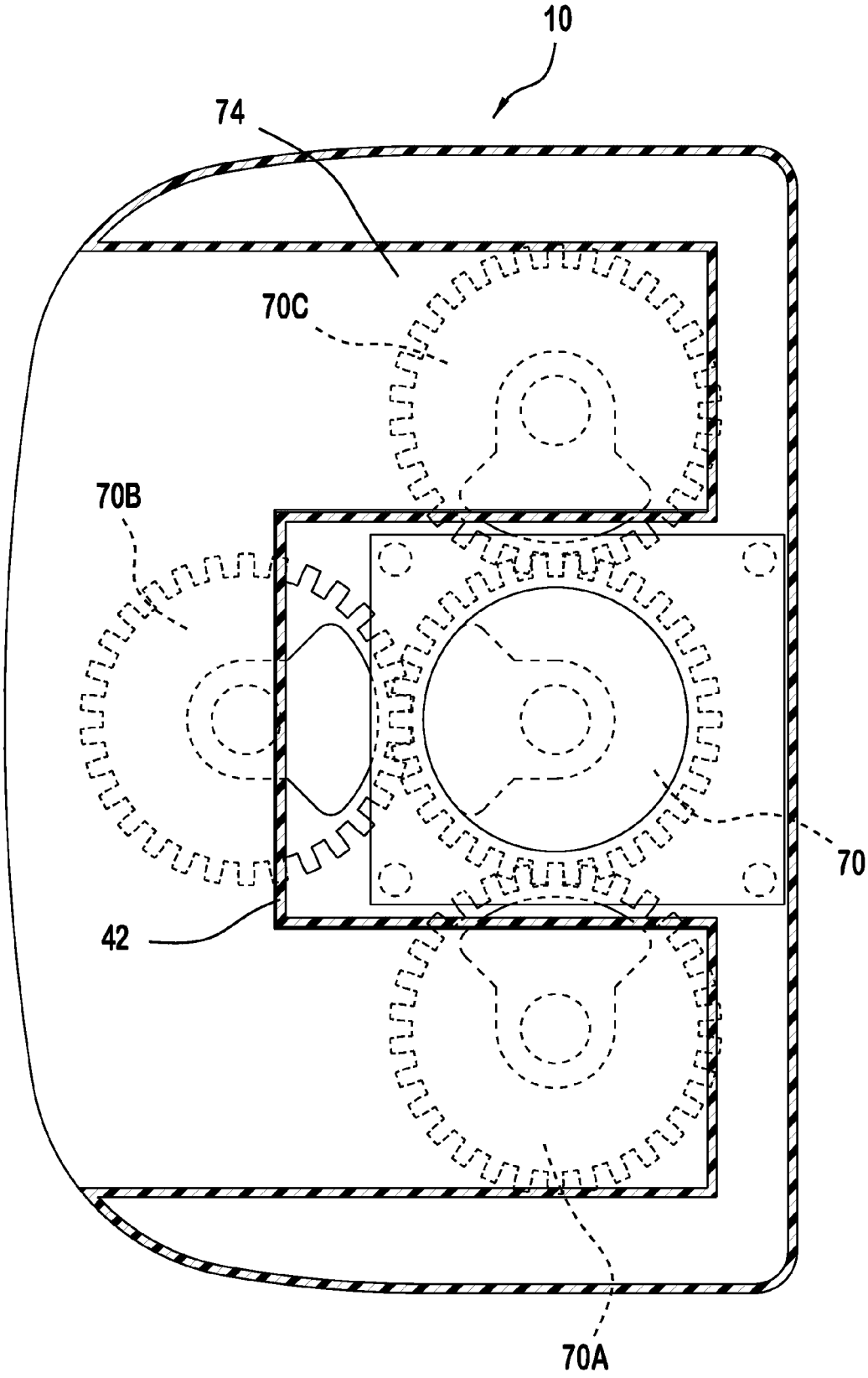
FIG. 6 is a top plan view of the gears of FIG. 5 showing one preferred engagement of the drive gear with the first through third driven gears.

Referring to FIGS. 5 and 6, another alternate preferred vibration mechanism is shown. The motor 46 may be mounted on a base plate to support the motor 46 in a spaced apart relation from the bottom of the shredder housing 78. The motor drives a drive gear 70 that may be operatively engaged with a plurality of driven gears 70A-70C located on a shredder base and adapted to vibrate the base of the shredder 10 to facilitate settlement of shredded material 26 in the shredder basket 34. As best shown in FIG. 6, the drive gear 70 and driven gears 70A-70C may include eccentric weights (shown in dashed lines) mounted therewith to cause vibration when the gears are rotated.

While some preferred embodiments of the vibration mechanism 40 have been shown and described, those of skill in the art will appreciate that any suitable vibration mechanism can be used without departing from the scope of the present invention. Additionally, the vibration mechanism 40 can be located in the shredder housing 78, in the shredder basket 34, detachably attached to a shredder basket 34, and/or located in the shredder head housing 12 without departing from the scope of the present invention.

The shredder 10 may include a controller 22 that is in communication with a motor 46 in the shredder and is adapted to activate the vibration mechanism for a predetermined period of time after the material 26 has been shredded to facilitate settlement thereof. The preferred period of time is between approximately one and thirty seconds. However, those of ordinary skill in the art will appreciate from this disclosure that any desired period of time, such as two minutes, five seconds, or the like can be used without departing from the scope of the present invention.

Referring to FIG. 1, the shredder 10 preferably includes a selectable control 28, such as a power switch, that is in communication with the shredder 10 for manually activating the vibration mechanism 40. The control 28 has an activated state adapted to activate the vibration mechanism 40. This allows a user to facilitate the settlement of shredded material as desired. The shredder 10 may also include a remote control 76 for remotely activating the vibration mechanism 40.

The present invention also includes multiple preferred methods of shredding material. One preferred method of the present invention will be described in conjunction with various preferred embodiments of the shredder 10. The steps of any of the methods of the present invention can be performed in any order, omitted, or combined without departing from the scope of the present invention. As such, optional steps described in conjunction with one method can also be used with any of the other described methods. Additionally, unless otherwise stated, similar components described in conjunction with different methods preferably, buy not necessarily, operate in a generally similar manner to that described elsewhere in this application.

The first preferred method of shredding material, includes: providing a shredder 10 that defines at least one slot 14, 16 for receiving material. The shredder 10 includes a plurality of shredder blades 18 adapted to shred the material inserted into the at least one slot 14, 16. The shredder 10 includes a shredder basket 34 for receiving the material 26 after shredding. The shredder basket 34 is mechanically vibrated to encourage the settlement of the material 26 therein.

The method may include the shredder basket 34 automatically mechanically vibrating once the plurality of shredder blades 18 are deactivated. Thus, a user can set the shredder 10 to automatically vibrate the shredder basket 10 for a predetermined period of time after material is done being shredded. Similarly, the method of the present invention may include monitoring the shredder basket 34 to detect a bin full condition, which is when the material 26 has filled a predetermined amount/volume of the shredder basket 34. The shredder basket 34 can be automatically mechanically vibrated when the bin full condition is detected. Furthermore, the shredder basket 34 can be further monitored after vibration thereof (which was performed in response to initially detecting a bin full condition) to determine whether settlement of the material 26 has eliminated the bin full condition. By vibrating the shredder basket 34 after initially detecting a possible bin full condition, this method may resolve the bin full condition by further settling the shredded material 26 and thereby increasing the amount of material that can be shredded before needing to empty the shredder basket. The method can include activating a bin full indicator when a bin full condition continues to be detected after the shredder basket has been automatically vibrated in response to the initial detection of the bin full condition.

The step of vibrating may be accomplished by moving a portion of the shredder basket 34 through a generally arcuate path or through a generally linear path, as desired. The directional forces exerted on the shredder housing 78, the shredder head housing 10, another component of the shredder, or on the shredder basket 34 directly can be of any sort without departing from the scope of the present invention.

Another method of shredding material according to the present invention includes providing a shredder 10 defining at least one slot 14, 16 for receiving material. The shredder 10 includes a plurality of shredder blades 18 adapted to shred the material inserted into the at least one slot 14, 16. The shredder 10 includes a shredder basket 34 for receiving the material 26 after shredding. The shredder basket 34 is automatically mechanically vibrated to encourage the settlement of the material 26 therein when the plurality of shredder blades 18 are deactivated. By automatically vibrating the contents 26 of the shredder basket 34 the amount of material that can be shredded before needing to empty the shredder basket 34 may be increased.

Another preferred method of shredding material includes providing a shredder 10 defining at least one slot 14, 16 for receiving material. The shredder 10 includes a plurality of shredder blades 18 adapted to shred the material inserted into the at least one slot 14, 16. The shredder 10 includes a shredder basket 34 for receiving the material 26 after shredding. The shredder basket 34 is monitored to initially detect a bin full condition, which is when the material has filled a predetermined amount/volume of the shredder basket 34. The shredder basket 34 is automatically mechanically vibrated when the bin full condition is initially detected. After the automatic mechanical vibration in response to initially detecting the bin full condition, the shredder basket 34 is automatically rechecked to determine whether settlement of the material 26 therein has eliminated the bin full condition. If the bin full condition persists, then the method may include activating a bin full sensor (if after rechecking the shredder basket the bin full condition has not been eliminated by settlement of the material therein).

It is recognized by those skilled in the art that changes may be made to the above described methods and/or shredder 10 without departing from the broad inventive concept thereof. It is understood, therefore, that this invention is not limited to the particular embodiments disclosed, but is intended cover all modifications which are within the spirit and scope of the invention as defined by the above specification, the appended claims and/or shown in the attached drawings.

What is claimed is:

1. A method of shredding material, comprising:

providing a shredder defining at least one slot for receiving material, the shredder comprising a plurality of shredder blades adapted to shred the material inserted into the at least one slot, the shredder comprising a shredder basket for receiving the material after shredding and a shredder housing defining a chamber adapted to receive the shredder basket therein, a portion of the chamber being formed by a vibration mechanism housing; a vibration mechanism being at least partially positioned in the vibration mechanism housing and adapted to vibrate the shredder basket, the vibration mechanism being located proximate a bottom side of the chamber;

mechanically vibrating the shredder basket to encourage the settlement of the material therein.

2. The method of claim 1, wherein the step of mechanically vibrating further comprises mechanically vibrating the shredder basket automatically once the plurality of shredder blades are deactivated.

3. The method of claim 1, fun her comprising monitoring the shredder basket to detect a bin full condition, which is when the material has filled a predetermined amount of the shredder basket, and automatically mechanically vibrating the shredder basket when the bin full condition is detected.

4. The method of claim 3, further comprising monitoring the shredder basket after vibration thereof in response to detecting a bin full condition to determine whether settlement of the material has eliminated the bin full condition.

5. The method of claim 4, further comprising activating a bin full indicator when a bin full condition continues to be detected after the shredder basket has been vibrated in response to the initial detection of the bin full condition.

6. The method of claim 1 wherein the step of mechanically vibrating the shredder basket further comprises moving a portion of the shredder basket through a generally arcuate path.

7. The method of claim 1 wherein the step of mechanically vibrating the shredder basket further comprises moving a portion of the shredder basket through a generally linear path.

8. The method of claim 1, wherein the step of providing the shredder further comprises the vibration mechanism having at least one eccentrically mounted wheel adapted to vibrate the basket.

9. The method of claim 1, wherein the step of providing the shredder further comprises the vibration mechanism having at least one guide wheel that is oriented to generally rotate through a plane parallel to a bottom side of the chamber; the shredder basket comprising a rod that is adapted to engage the at least one guide wheel, the central axis of the rod and the at least one guide wheel being offset.

10. The method of claim 1, wherein the step of providing the shredder further comprises at least part of the shredder basket extending through a portion of the vibration mechanism housing, the vibration mechanism being adapted to engage the part of the shredder basket to vibrate the shredder basket.

11. The method of claim 1, wherein the step of providing the shredder further comprises the vibration mechanism having at least one eccentric weight such that motion of the at least one eccentric weight causes vibration.

12. A method of shredding material, comprising:

providing a shredder defining at least one slot for receiving material, the shredder comprising a plurality of shredder blades adapted to shred the material inserted into the at least one slot, the shredder comprising a shredder basket for receiving the material after shredding and a shredder housing defining a chamber adapted to receive the shredder basket therein, a portion of the chamber being formed by a vibration mechanism housing; a vibration mechanism being at least partially positioned in the vibration mechanism housing and adapted to vibrate the shredder basket, the vibration mechanism being located proximate an intersection of bottom and rear sides of the chamber, at least part of the shredder basket extending through a portion of the vibration mechanism housing, the vibration mechanism being adapted to engage the part of the shredder basket to vibrate the shredder basket;

automatically mechanically vibrating the shredder basket to encourage the settlement of the material therein when the plurality of shredder blades are deactivated.

13. A method of shredding material, comprising:

providing a shredder defining at least one slot for receiving material, the shredder comprising a plurality of shredder blades adapted to shred the material inserted into the at least one slot, the shredder comprising a shredder basket for receiving the material after shredding and a shredder housing defining a chamber adapted to receive the shredder basket therein, a portion of the chamber being formed by a vibration mechanism housing; a vibration mechanism being at least partially positioned in the vibration mechanism housing and adapted to vibrate the shredder basket, the vibration mechanism being located proximate an intersection of bottom and rear sides of the chamber, the vibration mechanism having at least one eccentrically mounted wheel adapted to vibrate the basket;

monitoring the shredder basket to initially detect a bin full condition, which is when the material has filled a predetermined amount of the shredder basket;

automatically mechanically vibrating the shredder basket when the bin full condition is initially detected;

after the automatic mechanical vibration in response to initially detecting the bin full condition, automatically rechecking the shredder basket to determine whether settlement of the material therein has eliminated the bin full condition.

14. The method of claim 13, further comprising only activating a bin full sensor if after rechecking the shredder basket the bin full condition has not been eliminated by settlement of the material therein.

15. A method of shredding material, comprising:

providing a shredder defining at least one slot for receiving material, the shredder comprising a plurality of shredder blades adapted to shred the material inserted into the at least one slot, the shredder comprising a shredder basket for receiving the material after shredding and a shredder housing defining a chamber adapted to receive the shredder basket therein, a portion of a side of the chamber being formed by a vibration mechanism housing; a vibration mechanism being at least partially positioned in the vibration mechanism housing and adapted to vibrate the shredder basket, the vibration mechanism being located between a bottom side of the chamber and a base of the shredder housing;

mechanically vibrating the shredder basket to encourage the settlement of the material therein.

* * * * *